United States Patent [19]

Sherman

[11] 3,965,643

[45] June 29, 1976

[54] TOPPER UNIT, MACHINE AND METHOD

[75] Inventor: Earle Conrad Sherman, West Monroe, La.

[73] Assignee: Olinkraft, Inc., West Monroe, La.

[22] Filed: Oct. 10, 1975

[21] Appl. No.: 621,446

[52] U.S. Cl. ..... 53/29; 53/49; 53/186

[51] Int. Cl.[2] ..... B65B 21/04; B65B 43/30

[58] Field of Search ..... 53/29, 48, 49, 186, 53/196, 292

[56] References Cited

UNITED STATES PATENTS

| | | | |
|---|---|---|---|
| 1,962,481 | 6/1934 | Clark | 53/186 X |
| 3,267,566 | 8/1966 | Ouellette | 53/292 X |
| 3,412,652 | 11/1968 | McIntyre | 53/186 X |
| 3,492,778 | 2/1970 | Focke | 53/49 |

*Primary Examiner*—Robert L. Spruill
*Attorney, Agent, or Firm*—Norvell E. Von Behren

[57] ABSTRACT

A topper unit is disclosed which may be utilized for opening, applying and locking a pre-glued open ended carton to the top of a bottle which is being progressively moved through the machine employing the topper unit. The topper unit may be used either singly, doubly, or in greater multiples in a packaging machine and comprises a hopper for receiving the pre-glued and folded cartons. Located below the hopper are means for removing the cartons one at a time from the hopper while opening the cartons so that they can later be applied to the top of the bottle. When the cartons have been opened one at a time, they are then pressed onto the bottle while they are squared up and are then ultimately locked onto the bottle. Also disclosed is a new and novel method for withdrawing a pre-glued open ended folded carton from a hopper and opening the carton and applying it to the top of a bottle or a plurality of moving bottles.

19 Claims, 22 Drawing Figures

TOPPER UNIT, MACHINE AND METHOD

BACKGROUND OF THE INVENTION

This invention relates generally to a packaging machine and method and more particularly to a new and novel topper unit designed for use in a machine which packages moving bottles by opening a pre-glued open ended carton and applying and locking the opened carton to the bottle by means of a locking surface contained on the carton which engages a rim around the central portion of the carton.

In the packaging of the newer type plastic bottles such as the bottle shown in FIG. 1 of the drawing, it is generally desirous to position a carton, shown generally by the numeral 12, over the top 14 of the bottle with the top of the carton 12 resting on the lid 16 of the bottle and with the carton locked onto the rim 18 of the bottle by means of a plurality of locking surfaces 20. By referring to FIG. 2 of the drawing there is shown the general type of carton 12 which is utilized in the subject invention and forms no part of the applicant's invention, but is described herein in detail for purposes of more fully understanding the applicant's use of the carton in his topper unit and machine. The carton 12 is formed from a plurality of side panels 22, 24, 26 and 28 hingedly attached to each other by means of a plurality of scorelines 30, 32 and 34.

The carton 12 also has formed on the upper edges thereof, a plurality of top panels 36, 38, 40 and 42 which are hingedly attached to their respective side panels by means of the scorelines 44, 46, 48 and 50. The side panels also have hingedly attached thereto, by means of the scorelines 52, 54, 56 and 58, a series of flaps 60, 61, 63 and 65. These flaps contain the respective locking surfaces 20 hereinbefore mentioned which are designed to lock onto the bottom of the rim 18 of the bottle 10 whenever the carton 12 is positioned over the top of the bottle as shown in FIG. 1 of the drawing. The flaps 60, 61, 63 and 65 are folded inwardly against their respective sides along the scorelines 52, 54, 56 and 58 whenever the carton is initially glued and folded into the pre-glued carton utilized in the applicant's hopper.

Completing the carton 12 is a manufacturer's flap 62 which is hingedly attached to the side panel 22 by means of the scoreline 64. The top panels 38 and 42 are divided approximately in half by means of the scorelines 66 and 68 forming upper portions 70 and 72 upon which may be positioned a predetermined quantity of glue shown by the stippling 74. In addition, the side panel 28 has a predetermined quantity of glue positioned on the end thereof as shown by the stippling 76.

The hereinbefore described carton forms no part of the subject invention and it is believed is more fully described in a pending patent application in the United States Patent Office and reference may be made to that application for a fuller understanding of how the subject carton 12 is folded and pre-glued so that it may be utilized in the applicant's hopper on his topper unit and topper machine. It should be sufficient to state, however, that when folded and pre-glued, the top panels 36, 38, 40 and 42 are folded inside of the carton and the flaps 60, 61, 63 and 65 are also folded inside the carton with the side panels 26 and 28 being hinged about the scoreline 32 into juxtaposition with the side panels 22 and 24. When in this position the manufacturer's flap 62 is glued to the side panel 28 by means of the adhesive shown by the stippling 76. In this manner the entire carton 12 is then in a pre-glued and folded horizontal position prior to being placed in the applicant's hopper and ultimately opened on top of the bottle 10 as shown in FIG. 1 of the drawing.

When the subject carton 12 was designed, it was originally positioned on top of the bottle 10 by hand thereby resulting in a slower packaging time and assembly line speeds. It had been felt desirous to be able to package the carton 12 on the bottle 10 at speeds approximating 200 or more cartons per minute which was probably beyond the capabilities of one person to hand package at those speeds.

SUMMARY OF THE INVENTION

In order to overcome the difficulty inherent in the hand packaging of the subject carton, there has been provided by the subject invention a new and improved topper unit which is designed to replace the hand operation hereinbefore described with a rapid high-speed machine which is capable of automatically packaging at least 100 bottles per topper unit and when used in multiples of more than one topper unit per machine may package up to 200, 300 or more bottles per minute.

The subject invention comprises a new and novel topper unit which is designed to withdraw the pre-glued and folded horizontally stacked cartons from a hopper and then to open the cartons while removing them from the hopper and at the same time to move and position a bottle beneath the opened carton and to finally press the opened carton on top of the bottle while squaring it up so that it may be ultimately locked onto the bottle as hereinbefore described. The subject hopper unit may be utilized in a machine which supplies the bottles beneath the topper unit in a separated sequence so that the topper unit or units may apply a carton on top of each bottle passing underneath the topper unit or upon alternate bottles whenever several topper units are utilized in combination either side by side or end for end.

Accordingly, it is an object and advantage of the invention to provide a new and improved topper unit and machine which is designed to replace hand operation by automatically withdrawing a pre-glued and folded horizontally stacked carton from a hopper and opening and applying and locking the pre-glued carton onto the bottle.

Yet another object of the invention is to provide a new and improved topper unit for use in a machine which is utilized for opening and applying and locking a pre-glued carton to the top of the bottle with the use of a plurality of novel combinations of machine elements heretofore unassembled in that combination.

Still yet another object and advantage of the invention is to provide a new and improved topper unit that may be utilized in packaging machines which is capable of packaging 100 bottles per minute per topper unit and when used in multiples of two, three or more is able to obtain high packaging speeds.

Still yet another object and advantage of the invention is to provide a new and novel method for withdrawing a pre-glued open ended and folded horizontally stacked carton from a hopper and opening the carton and applying it to the top of a bottle.

DESCRIPTION OF THE PREFERRED EMBODIMENT

Figure 2:
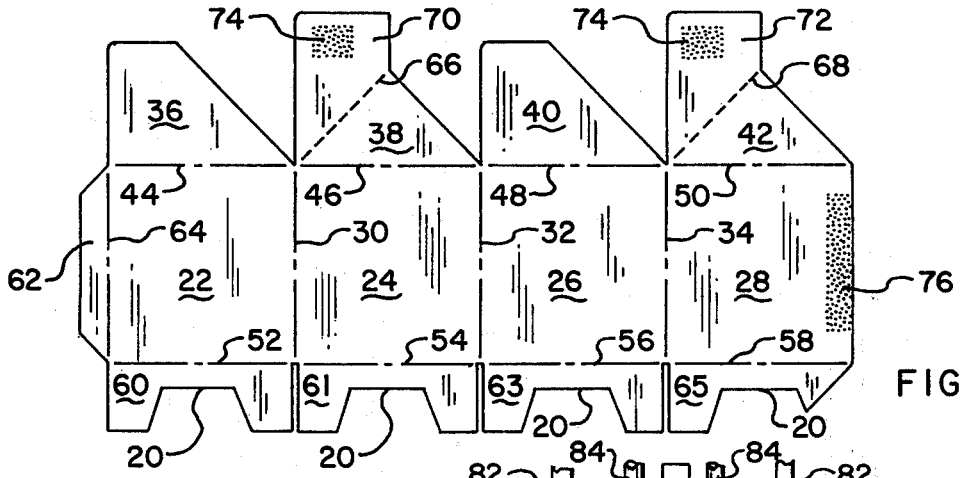
FIG. 2 is a plan view of a production blank of the subject carton shown in FIG. 1 of the drawing.
Figure 3:
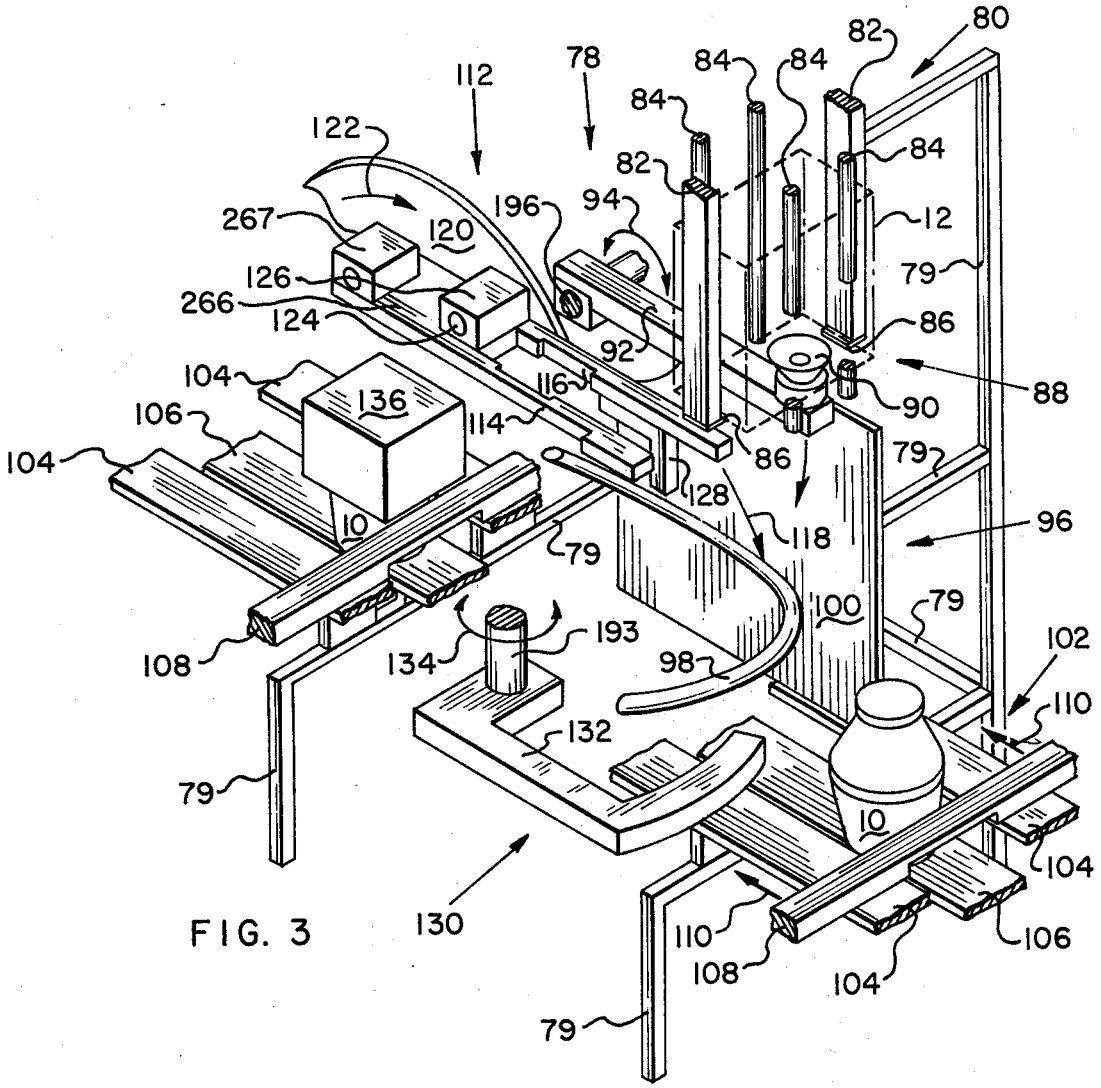
FIG. 3 is a perspective view of the subject new and novel topper unit showing the respective parts thereof and their relative location to each other.

Referring now to the drawings in general and particularly to FIG. 3 of the drawings there is shown a perspective view of the subject new and novel topper unit, shown generally by the numeral 78 which is designed for opening, applying and locking a pre-glued open ended carton of the type hereinbefore described and as shown in FIG. 2 of the drawing to the top of the bottle 10. The basic elements of the topper unit are shown in FIG. 3 of the drawing, with the remaining elements omitted for purposes of clarity, and comprise basically a frame 79 and a hopper, shown generally by the numeral 80, which is mounted on the frame and serves as a receptacle for the plurality of pre-glued and horizontally stacked folded cartons of the type hereinbefore described. The hopper 80 is formed with a plurality of side rails 82 and a plurality of guide rods 84, with the side rails 82 and guide rods 84 being designed to hold the pre-glued and folded cartons 12 which are contained within the hopper 80. Positioned on the bottom of the side rails 82 are stop plates 86 which are designed to retain the cartons 12 within the hopper 80 and to keep them from dropping out of the bottom of the hopper until they are withdrawn by the removing means.

Associated with the hopper 80 and located below it are removing means for removing the cartons one at a time from the hopper. The removing means are shown generally by the numeral 88 and comprise in the preferred embodiment a rotatably mounted air operated suction cup 90 which is carried by the suction cup arm 92 and is designed for a rocking motion in the direction shown by the arrow 94. The suction cup 90 is positioned beneath the hopper 80 and is designed to withdraw the cartons 12 one at a time from the bottom of the hopper 80 in a timed relationship.

Figure 5:
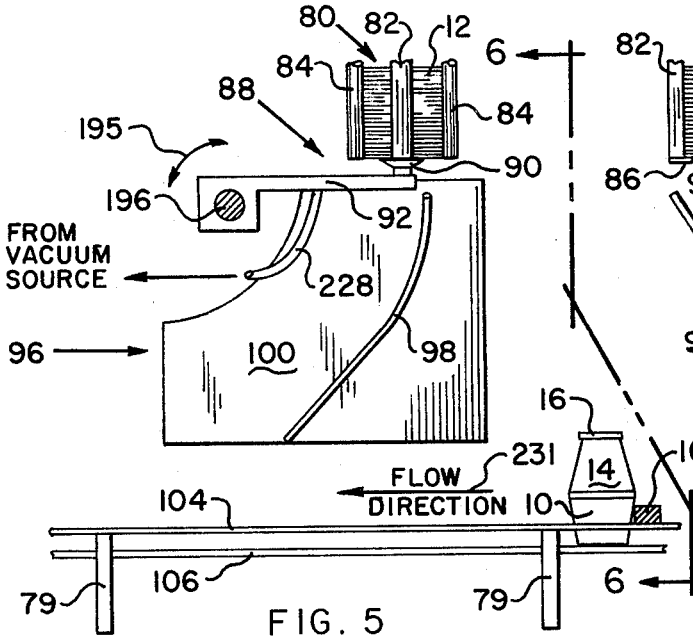
FIG. 5 is a side view of the hopper section of the subject topper unit showing the removing means for removing the cartons from the hopper and the opening means utilized for opening the cartons which are removed from the hopper by the removing means.
Figure 6:
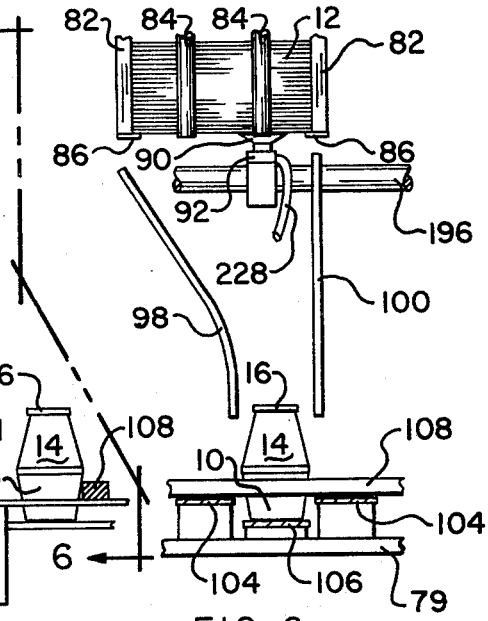
FIG. 6 is an end view, taken along line 6—6 of FIG. 5, showing the relative positions of the static folding rail and static folding plate in relation to the hopper and the bottle moving into position underneath the hopper.

Mounted on the frame and located beneath the hopper 80 are opening means, shown generally by the numeral 96, for opening the cartons 12 while the removing means 88 is removing the cartons 12 from the hopper 80. The opening means in the preferred embodiment comprises at least one static folding rail 98 which is positioned beneath the hopper 80 and is located on one side of the hopper. The opening means also comprises a static folding plate 100 which is located beneath the hopper 80 and is located on the other side of the hopper opposite to the static folding rail 98. The static folding plate 100 is a substantially vertical flat plate which is fastened to the frame by means well known in the art while the static folding rail 98 is a bent rail in the configuration shown in FIG. 3 of the drawing and also as shown in FIGS. 5 and 6 of the drawings. The static folding rail 98, like the static folding plate 100, is also rigidly fastened to the frame by means well known in the art and forming no part of the invention. For purposes of clarity, the frame 79 has generally been omitted from FIG. 3 of the drawing and from most of the drawing figures and would represent the basic static base or unit upon which the topper unit and machine is constructed. The opening means 96 as well as the other basic parts of the topper unit will be described more fully hereinafter when referring to FIGS. 5–19 of the drawings and are described at the present time in relationship to FIG. 3 only for illustrative purposes to enable the reader to more fully understand the various basic elements of the topper unit and how they interact with each other.

Associated with the frame 79 and positioned below the hopper are means for moving and positioning a bottle 10 beneath the opened carton. The moving and positioning means are shown generally by the numeral 102 and comprises in the preferred embodiment a pair of guide rails 104 which are mounted on the frame 79 and are positioned over a centrally located frame mounted dead plate 106.

The moving and positioning means 102 further comprises a chain driven and timed horizontally traveling flight bar 108 which is positioned over the guide rails 104 and the dead plate 106 and is designed for engaging and moving the bottles 10 generally in the direction shown by the arrows 110. The flight bar 108 is timed with the rest of the basic elements and is driven off of the main machine motor.

Figure 1:
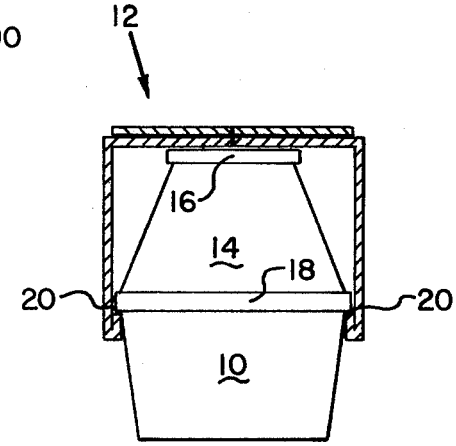
FIG. 1 is a side view partially in section showing a pre-glued open ended carton of the type hereinbefore described locked onto a bottle, the bottle being shown whole while the carton is shown in section in order to show how the carton is locked onto the bottle.

Associated with the frame 79 and positioned beneath the hopper 80 are means for pressing the previously opened carton on top of the bottles 10 and for firmly locking it onto the bottle in the position shown in FIG. 1 of the drawing. The pressing means, shown generally by the numeral 112 comprises in the preferred embodiment a pair of vertically moving presser arms 114 and 116 which are mounted for movement in the direction shown generally by the arrow 118 to be downwardly and away from the hopper 80 by means of the rotating cam 120 which rotates in the direction shown by the arrow 122. The cam 120 then in turn, moves a pin 124 which carries the presser arms 114 and 116 by means of the block 126. The presser arm 116 has formed thereon a downwardly extending stop 128 which is in juxtaposition to the static folding plate 100 and whose function will be described more fully hereinafter.

Associated with the frame 79 and positioned below the hopper 80 are means for squaring up the carton 12, shown generally by the numeral 130, as the carton 12 is being pressed on top of the bottle 10. In the preferred embodiment, the squaring means comprises a horizontally rotating squaring arm 132 which is generally C shaped and is designed for horizontal rotation in the direction shown by the arrow 134 to drive the opened carton against the downwardly extending stop 128 and against the static folding plate 100 as will be described more fully hereinafter when referring to FIGS. 11 and 12 of the drawing.

Figure 4:
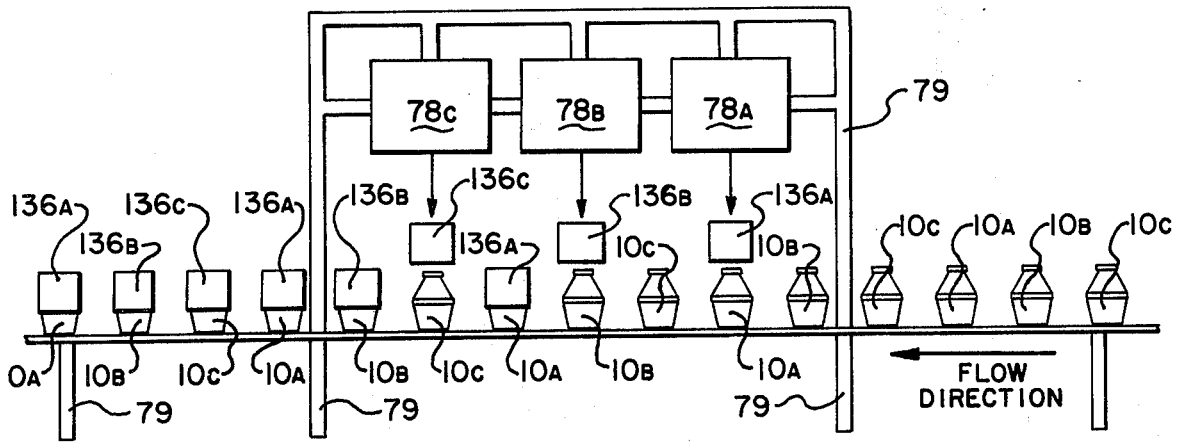
FIG. 4 is a side schematic view of a plurality of topper units utilized in a machine for the high speed packaging of bottles of type shown in FIG. 1 of the drawing, showing the location of the topper units in relation to the machine frame and the moving bottles.
Figure 18:
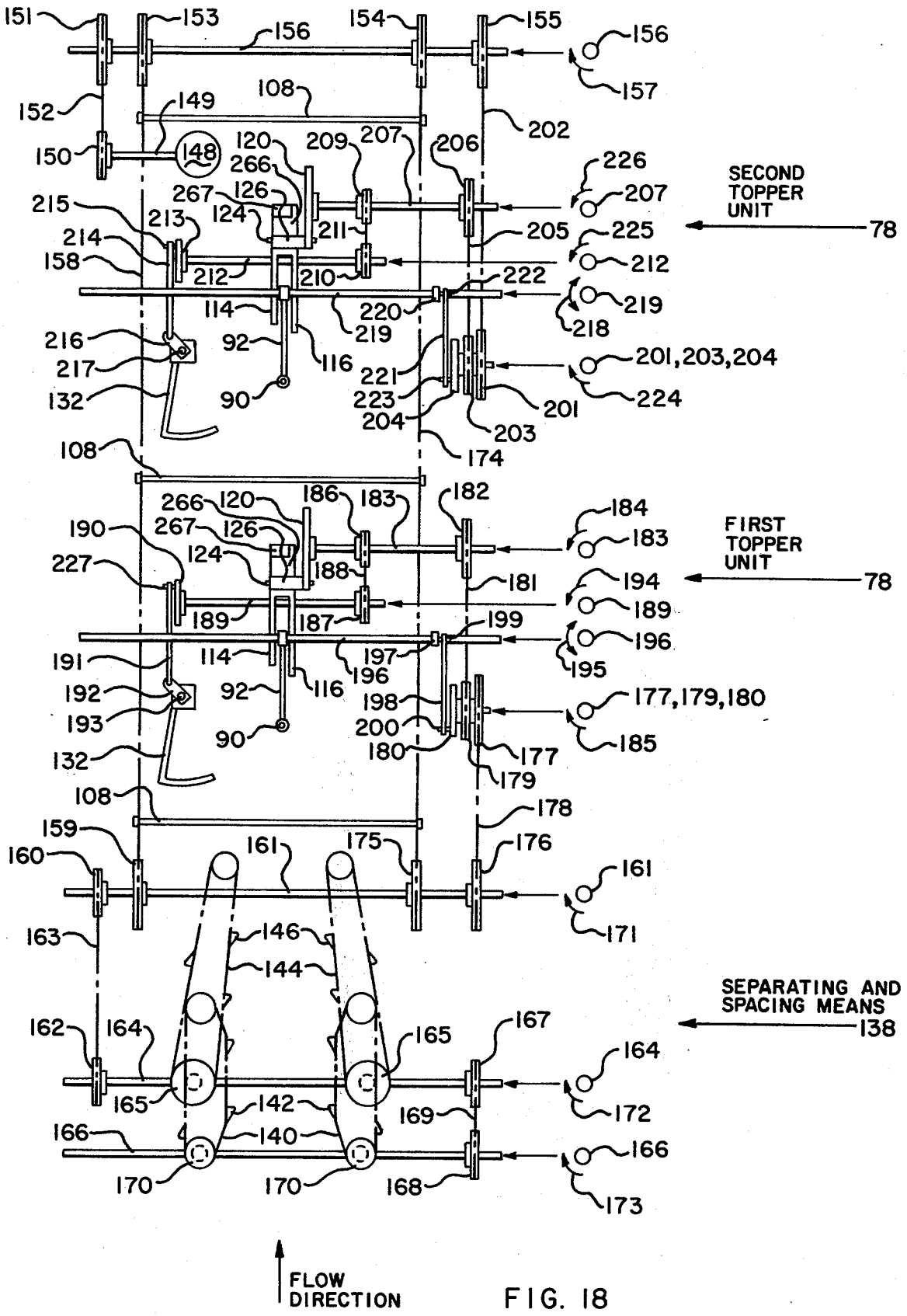
FIG. 18 is a schematic diagram showing the various components of the subject invention and how they are connected together by means of the various shafts and chains and showing also two topper units utilized together with a separating and spacing means to form a topping machine.

The topper unit 78 hereinbefore described may be used singly as shown in FIG. 3 of the drawing to apply an opened carton 136 to a single bottle 10. The topper unit 78 may also be used in multiples of two, three or more topper units in order to be able to speed up the topping process to a desired speed. For example, by referring to FIG. 18 of the drawing, there is shown a schematic of the various basic parts of the subject invention wherein two topper units 79 are utilized with one topper unit located downstream from the other topper unit and it should become obvious that when using two topper units 78, twice as many bottles can be topped at the same time. In a similar manner, by referring to FIG. 4 of the drawing there is shown a side schematic view of the machine which utilizes three topper units 78 located in a row for topping still more bottles which are moving down the packaging line. When constructed thusly the first topper unit, shown generally by the numeral 78A would apply an open carton shown by the numeral 136A to the first bottle 10A of three previously spaced bottles. In a similar manner, the second topper unit, shown generally by the numeral 78B would apply an open carton 136B to the second bottle 10B of the previously separated groups of bottles. And in a like manner, the third topper unit 78C would apply an open carton 136C to the third bottle 10C of the previously grouped and separated bottles. From a reference to FIG. 4 of the drawing and FIG. 18 of the drawing it should become obvious that one or more topper units 78 may be utilized side by side or end by end in order to achieve the desired speeds of packaging as required by the customer. It has been found from experimentation that one topper unit 78 of the subject design will be able to top approximately 100 bottles per minute so it should become obvious that whenever two topper units are utilized as shown in FIG. 18 of the drawing that speeds of up to 200 bottles per minute are possible and whenever three topper units are utilized as shown in FIG. 4 of the drawing, then speeds of up to 300 bottles per minute are possible. It should also become obvious that higher speeds may be possible by the utilization of more than three topper units as desired.

Whenever the topper unit or units 78 are utilized in a machine for opening, applying and locking a plurality of pre-glued cartons to the tops of a plurality of moving separated bottles, it becomes necessary to provide for separating and spacing the bottles in a single file or in multiple files at a predetermined distance from each other in order that the bottles will be properly grouped and spaced so that they may be advanced beneath the respective hoppers for the placement of the opened cartons onto the top of the bottles. Such a separating and spacing means is shown generally by the numeral 138 in FIG. 18 of the drawing and is of the similar type which has been generally utilized with applicant's previously designed packaging machines designed for packaging wrap-around packages over a plurality of previously grouped and spaced bottles. Such a grouping and separating and spacing device is shown in the applicant's U.S. Pat. No. 3,194,381, issued to E. C. Sherman on July 13, 1965. By referring to that patent in particular, it will be seen how that basic design may be easily modified by one skilled in the art to be utilized to separate and space single bottles of the type designed for the subject topping machine to enable the bottles to be properly separated and spaced at any desired interval or in any desired manner according to the particular location of the various topping units whether end for end or side by side when packing multiple groups of bottles.

The separating and spacing means 138 of the type typified by the subject patent comprise a pair of selector chains 140 having a plurality of selector lugs 142 fixedly attached to the chains 140. In addition, the separating and spacing means 138 comprises a second set of chains, known generally as speed-up chains 144 which have a plurality of speed-up lugs 146 also fixedly attached thereto. From this information and from referring to the teachings in the subject patent, it can be seen how the patented grouping apparatus of the applicant's design can be modified to provide the necessary separating and/or grouping required for use in a machine having one or more topper units contained within the machine.

Having given the reader an understanding of what is meant by a topper unit and what forms the basic parts of the subject topper unit, reference should now be made in some detail to FIG. 18 of the drawing which shows two such topper units 78 utilized in combination with a separating and spacing means 138 to form a machine which is designed for opening, applying and locking a plurality of pre-glued and folded cartons 12 to the tops of a plurality of moving separated bottles 10. In referring to FIG. 18, it should be noted for clarity purposes, the hoppers 80 have eliminated from FIG. 18 and FIG. 18 has been designed to show the relative placement of the basic parts and the relative rotation of the various shafts and chains and the interconnecting of the shafts and chains in order to more fully understand how the various parts are interconnected and timed together so as to achieve their desired motion at a desired time.

The subject machine of the preferred embodiment may be driven by a single motor 147 by means of the shaft 149 which in turn drives a sprocket 150 which is fixedly attached to the shaft 149 by means well known in the art. The sprocket 150 drives another sprocket 151 by means of a chain 152 and also drives a series of sprockets 153, 154 and 155 by means of the shaft 156. The sprocket 154 drives the horizontally traveling flight bars 108 as will be described more fully hereinafter. The rotation of the shaft 156 is shown on the right side of FIG. 18 by the arrow direction 157. The shaft 156 and sprocket 153 in turn drive the separating and spacing means 138 by means of the chain 158 and sprocket 159 as well as the sprocket 160 which is fixedly attached to the shaft 161 by means well known in the art. The sprocket 160 in turn drives a sprocket 162 by means of the chain 163. The sprocket 162 is fixedly attached to a shaft 164 which drives the sprocket 165 which in turn drives the speed-up chains 144 as hereinbefore described and as shown in the subject patent. The shaft 164 also drives a shaft 166 by means of a pair of sprockets 167 and 168 connected to a chain 169. By this means the sprockets 170 of the selector chains 140 are able to be driven through the shaft 166.

The relative rotation of the shafts 161, 164 and 166 are shown by the arrows 171, 172 and 173 to the right of FIG. 18.

The shaft 161 also is utilized to drive the first topper unit 78 in the packaging line through the chain 178 which is driven by a sprocket 176 fixedly mounted on the shaft 161. The sprocket 176 is utilized to drive a sprocket 177 by means of the chain 178. Mounted on the sprocket 177 is a sprocket 179 as well as a cam 180. The sprocket 179 is utilized to drive the presser arms 114 and 116 by means of a chain 181 driving a sprocket 182 fixedly mounted on a shaft 183 by means well known in the art. The relative direction of rotation of the shaft 183 is shown by the arrow 184 and the relative rotation of the sprocket 177, the sprocket 179 and the cam 180 is shown by the arrow 185 on the right side of FIG. 18.

The shaft 183 drives the presser arms 114 and 116 by means of the cam 120 and also drives the squaring arm 132 by means of the sprocket 186 which drives the sprocket 187 by means of the chain 188. The sprocket 187 is fixedly mounted on the shaft 189 which is utilized to drive the squaring arm 132 by means of a cam 190 driving the arm 191 through the pin 227 and the plate 192 fixedly attached to the squaring arm 132 by means of the pin 193. The relative rotation of the shaft 189 is shown by the arrow 194 on the right side of FIG. 18.

The suction cup 90 of the first topper unit is driven in a back and forth direction as shown by the arrow 195 by means of the shaft 196 which is driven by a rigid plate 197 pinned to an arm 198 by means of the pin 199. The arm 198 is also pinned to the cam 180 by means of the pin 200. The suction cup 90 of both topper units would have attached thereto a suction means in the form of a vacuum source and connecting tubing as is well known in the art.

The second topper unit 78 which is located downstream from the first topper unit 78 is driven from the main drive shaft 156 by means of the sprocket 155 which drives a sprocket 201 by means of a chain 202. Fixedly mounted to the sprocket 201 is a sprocket 203 and a cam 204. The sprocket 203 is utilized to drive the presser arms 114 and 116 by means of the chain 205 which drives the sprocket 206 which is in turn rigidly fastened to the shaft 207 by means well known in the art. The shaft 207 in turn drives the cam 120 which in turn drives the presser arms 114 and 116 by means of the pin 124 positioned within the block 126.

The shaft 207 also drives the squaring arm 132 by means of the sprocket 209 which in turn drives the sprocket 210 by means of the chain 211. The sprocket 210 is fixedly mounted on the shaft 212 which in turn has mounted on the other end thereof a cam 213 for driving an arm 214 through the pin 215. The arm 214 in turn drives the plate 216 through the pin 217 to drive the squaring arm 132 in the manner desired.

The suction cup 90 of the second topper unit 78 is driven in a back and forth motion shown by the arrow 218 through the shaft 219 which has fixedly attached thereto a plate 220 for driving an arm 221 through the pin 222. The other end of the arm 221 is attached to the cam 204 by means of the pin 223.

The relative rotation of the sprocket 201, the sprocket 203 and the cam 204 is shown by the arrow 224 while the relative rotation of the shaft 212 is shown by the arrow 225 with the arrow 226 showing the relative rotation of the shaft 207.

One side of the horizontally traveling flight bars 108 is fixedly attached to the flight bar chain 174 which is driven by the sprocket 154 attached to the shaft 156 and the sprocket 175 attached to the shaft 161. The other side of the horizontally traveling flight bars 108 is fixedly attached to the chain 158 by means well known in the art. It should be noted that in FIG. 18 three flight bars 108 are shown only for purposes of clarity and in the actual topper machine more or less number of flight bars 108 may be utilized as dictated by the particular design of the machine and the desired spacing of the bottles in relation to the various topper units.

When constructed thusly, the packaging machine utilizing two topper units 78 as shown in FIG. 18 of the drawing and comprising the separating and spacing means 138 will thusly be timed and synchronized in such a manner that the respective topping units and the separating and spacing means can function properly to do their required operation in the overall machine. It has been found from experimentation that in such a dual topper unit machine as shown in FIG. 18, a motor 148 of approximately ¾ horsepower is satisfactory for driving the entire packaging line.

Referring now specifically to FIGS. 5–17 of the drawings, there is shown in somewhat more detail the basic components of the subject invention which are shown in FIG. 3 of the drawing and which have been broken out of FIG. 3 in order to make sure that the reader has a complete understanding of how each component operates and reacts in relation to the next succeeding component in the unit. FIG. 5 is a side view of the hopper 80 of the subject topper unit which shows the removing means 88 and the opening means 96 of the subject invention. The removing means may comprise a rotatably mounted air operated suction cup 90 which is connected to a vacuum line 228 and ultimately to a vacuum source of the type well known in the art but not shown in the drawing. As has been before mentioned the rotating suction cup 90 is designed to rotate in a back and forth motion in the direction shown by the arrow 195 and is positioned so as to pull a single preglued folded carton 12 from the bottom of the hopper 80 one at a time in a predetermined time relationship. By referring to FIG. 6 of the drawing, there is shown a view taken along line 6—6 of FIG. 5 and it can be seen that the suction cup 90 with its supporting arm 92 is positioned on one side of the hopper so that it withdraws the carton 12 by pulling it downwardly by one side of the carton and then rotating it approximately 90° from its previous horizontal position as the suction cup arm rotates. The rotation of the carton from the horizontal position shown in FIG. 5 is shown by referring to FIGS. 7–10 of the drawings where it can be seen how the previously folded and unopened carton 12 is rotated downwardly and away from the hopper by means of the arm 92 thereby causing the carton to rotate 90° from its previous position lying in the bottom of the hopper to an open position as shown specifically in FIG. 9 of the drawings. In the open position the open ended portion of the carton 12 is facing downwardly prior to being positioned on the bottle 10.

Figure 7:
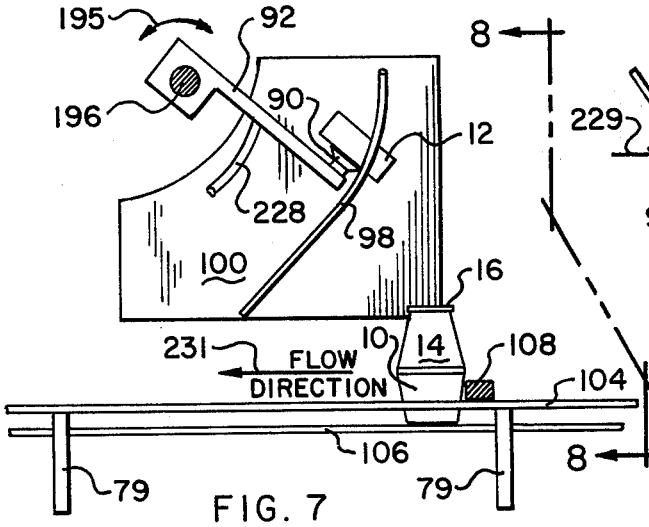
FIG. 7 is a side view similar to FIG. 5 showing the carton removed from the hopper, which has been omitted from FIG. 7, and showing the carton being partially opened by means of the opening means in the form of a static folding rail and static folding plate.
Figure 8:
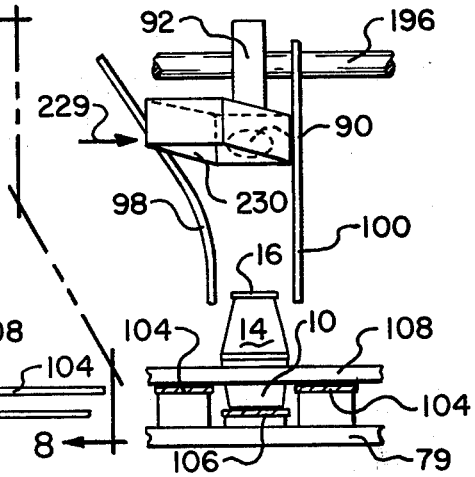
FIG. 8 is an end view, taken along line 8—8 of FIG. 7.

The opening means 96 of the subject invention may comprise at least one static folding rail 98 which is mounted on the frame 79 and is positioned beneath the hopper 80 as shown in FIGS. 5 and 6 of the drawing. In the preferred embodiment, only one static folding rail 98 has been utilized for the type of carton 12 which is used for 48-ounce plastic bottles 10 of the type shown in the drawing. However, it should become apparent that whenever larger bottles are to be packaged then a larger carton 12 must be utilized and more than one static folding rail 98 may be desirable. It should also be noted by referring to FIGS. 5 and 6 of the drawing, the exact configuration of the static folding rail 98 is shown and is designed to exert an opening force, shown by the arrow 229 in FIG. 8 of the drawing on the side 230 of the carton in such a manner that the carton is forced between the static folding rail 98 and the static folding plate 100 as the suction cup 90 is withdrawing the carton from the hopper and moving it downwardly and away from the hopper as shown in FIGS. 7 and 8 of the drawing. From this it can be seen that the cooperation of the static folding rail 98 and the static folding plate 100 causes the carton 12 to be opened from its previously folded position.

Simultaneously, while the carton 12 is being withdrawn from the hopper 80 and opened as shown in FIGS. 5–8 of the drawing, the bottle 10 is being moved and positioned beneath the opened carton by means of the traveling plate bar 108 which is moving in the flow direction shown by the arrow 231 to a position where it can ultimately accept the opened carton onto the top of the bottle 10. For example, it can be seen by referring to FIGS. 5, 7 and 9 of the drawings that the bottle is being moved by the traveling flight bar 108 into a position, shown in FIG. 9 of the drawing where the suction cup 90 and its supporting arm 92 is about to release the folded carton as the pressing arms 114 and 116 are being positioned to press the carton onto the top of the bottle.

Figure 9:
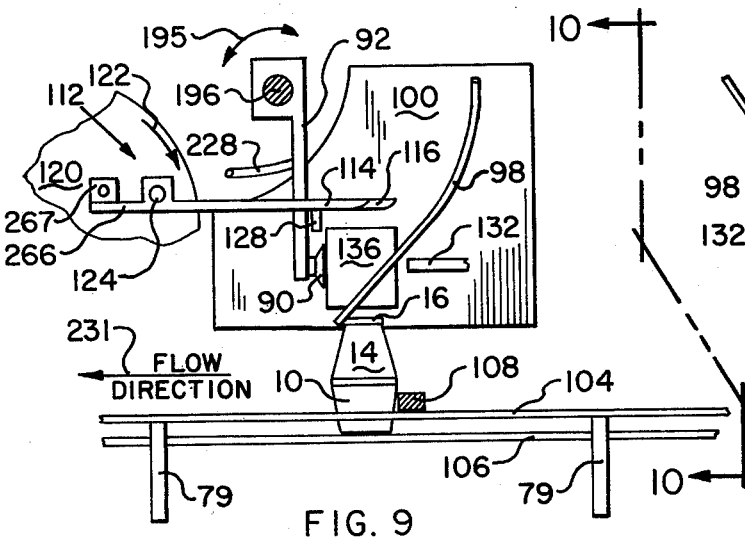
FIG. 9 is a side view, similar to FIG. 7 of the drawing, showing the carton completely opened with the presser means moving into position to press the carton onto the bottle.
Figure 10:
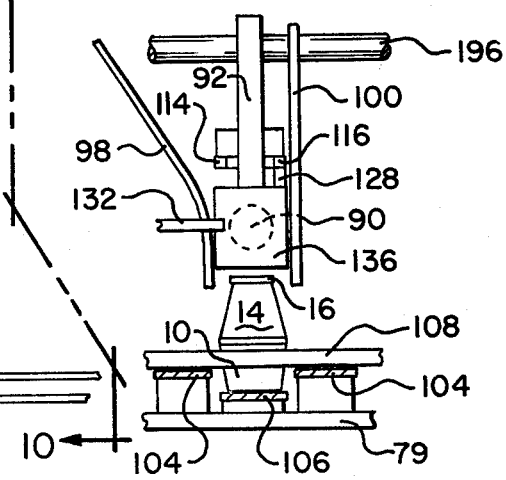
FIG. 10 is an end view, taken along line 10—10 of FIG. 9.
Figure 11:
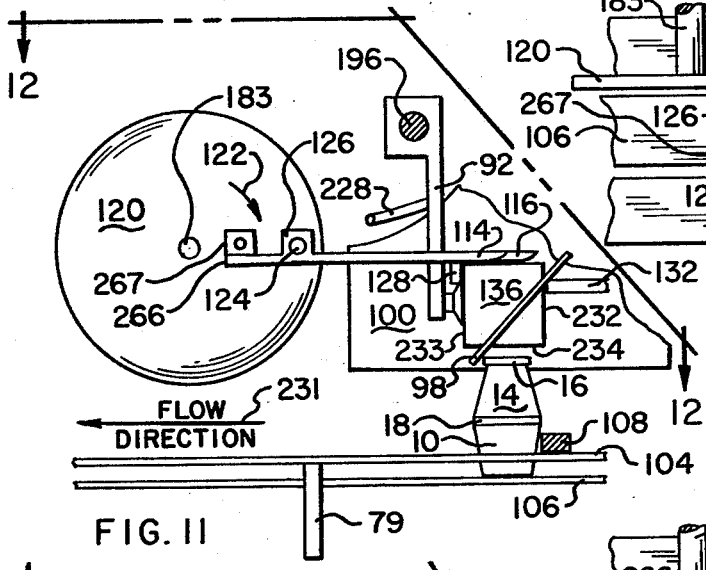
FIG. 11 is a side view similar to FIG. 9 showing the carton being pressed onto the bottle and simultaneously being squared up by the squaring means prior to its being positioned over the lid of the bottle.
Figure 12:
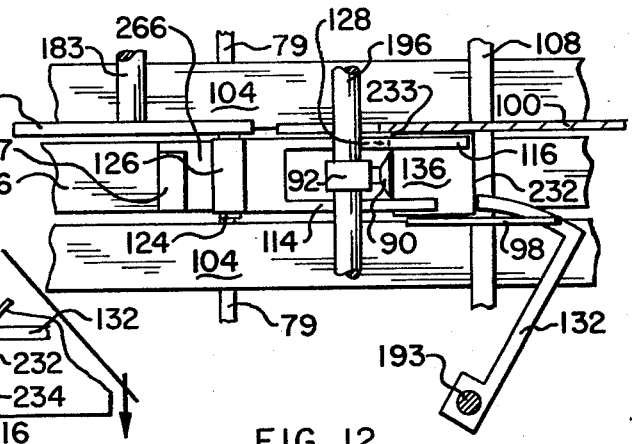
FIG. 12 is a top view taken along line 12—12 of FIG. 11.

This is the position which the bottle 10 occupies in FIG. 9 of the drawing and the completely opened carton, designated 136 to distinguish it from the folded carton 12, is now positioned a slight predetermined distance above the bottle lid. When in this position, the completely opened carton 136 still has a tendency to want to close or return to its previously folded position due to the spring back features of the paperboard forming the carton and it becomes necessary then to square up the carton or hold it open prior to its being positioned on top of the bottle 10. This squaring up is accomplished by means of the generally C shaped squaring arm 132, a portion of which is shown in FIGS. 9 and 10 of the drawing and which can be seen in more detail in FIGS. 11 and 12 of the drawing.

As has been before mentioned, the presser means 112 comprising a pair of presser arms 114 and 116 are cam operated by means of the cam 120 which is positioning the parallel mounted vertically moving presser arms 114 and 116 downwardly as shown by the arrow direction 122 to press the opened carton 136 onto the horizontally moving bottle 10. When the presser arms 114 and 116 have engaged the opened carton 136, the suction cup 90 and supporting arm 92 will be timed to release the carton by cutting off the vacuum to the suction cup 90. This condition is shown generally in FIGS. 11 and 12 of the drawings and reference should now be made to those two figures in order to more fully understood how the squaring up of the carton is achieved.

As has been before mentioned, the squaring arm 132 is a horizontally rotating squaring arm which is designed to engage a corner 232 of the opened carton 136 and to drive an opposite corner 233 of the opened carton 136 into the downwardly extending stop 128 and the static folding plate 100. When this is accomplished the opened carton 136 will remain in its squared position until the pressing arms 114 and 116 are able to position the leading bottom edge 234 of the opened carton 136 over the lid 16 of the bottle 10. Thereafter, the squaring arm 132 is able to be removed from the carton 136 since squaring up is no longer needed because the conical shape of the top portion of the bottle 10 will perform the squaring up function until the carton is locked securely onto the rim 18 of the bottle. That is to say the conical shape of the top portion of the bottle will act as a mandrel to square up and keep the carton 136 open so it can be locked onto the bottle 10.

Figure 15:
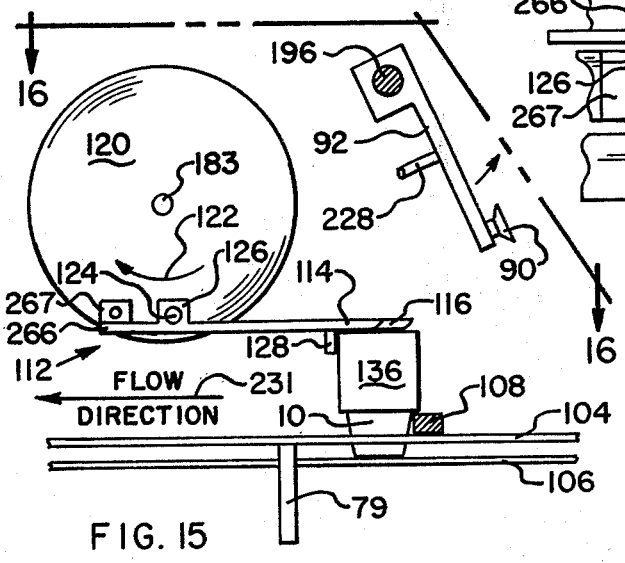
FIG. 15 is a side view similar to the view shown in FIG. 13 showing the presser means completely pressing the carton on top of the bottle and locking it into position.
Figure 16:
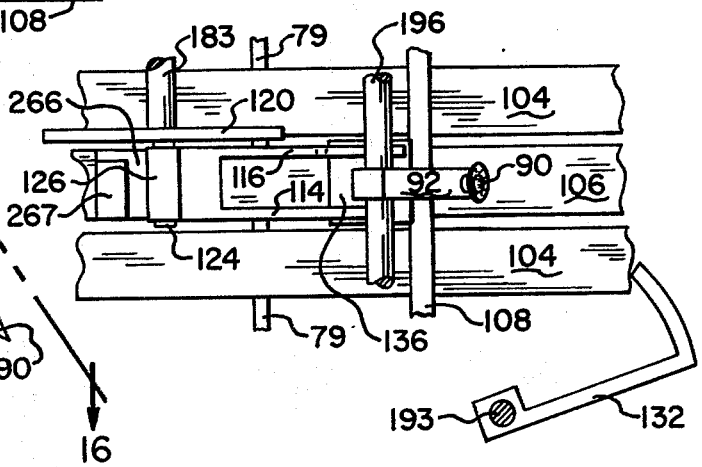
FIG. 16 is a top view taken along line 16—16 of FIG. 15.

Referring now to FIGS. 13–17 of the drawing there will be seen the final sequence in the operation wherein the pressing arms 114 and 116 are continuing to press the opened carton 136 onto the bottle 10 as the rotating cam 120 continues its motion shown by the arrow 122. It can be seen by referring to FIG. 13 of the drawing that the suction cup 90 has released the carton 136 and has reached its extreme left-hand position and is about to return to the hopper 80 in order to withdraw another folded carton blank 12 from the hopper. It can also be seen in FIGS. 13 and 14 of the drawing how the squaring arm 132 has withdrawn from the corner 232 and is returning to an out-of-the-way position as shown in FIG. 16 of the drawing prior to being reactivated and timed again to return to square up the next carton passing through the packaging machine. While this is occurring, the traveling flight bar 108 is continuing to move the bottles and the opened carton on top of the bottle downstream in the packaging machine to be ultimately shipped to the customer.

Figure 13:
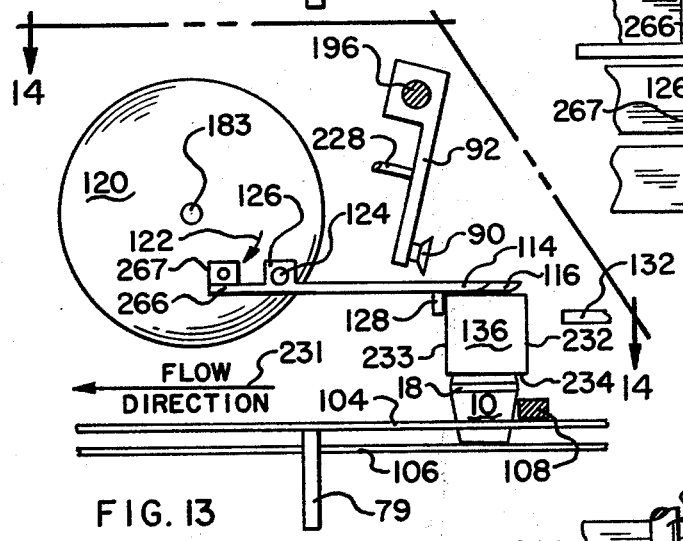
FIG. 13 is a side view similar to the view shown in FIG. 11 showing the carton being further pressed on top of the bottle and showing the pressing means being removed from the proximity of the carton.
Figure 14:
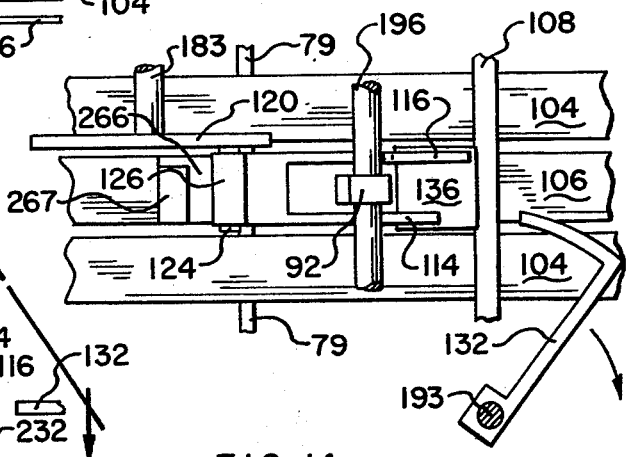
FIG. 14 is a top view taken along line 14—14 of FIG. 13.

By referring to FIG. 15 of the drawing, there is shown a side view similar to the view shown in FIG. 13 showing the presser means 112 completely pressing the opened carton 136 on top of the bottle 10 and locking it into position onto the rim 18 of the bottle 10 as has been before described and as is shown in FIG. 1 of the drawing. It can be seen that the suction cup 90 is proceeding to travel upwardly to the right and is ultimately returning to the bottom of the hopper 80 for withdrawing the next folded carton blank 12 from the hopper 80.

Figure 17:
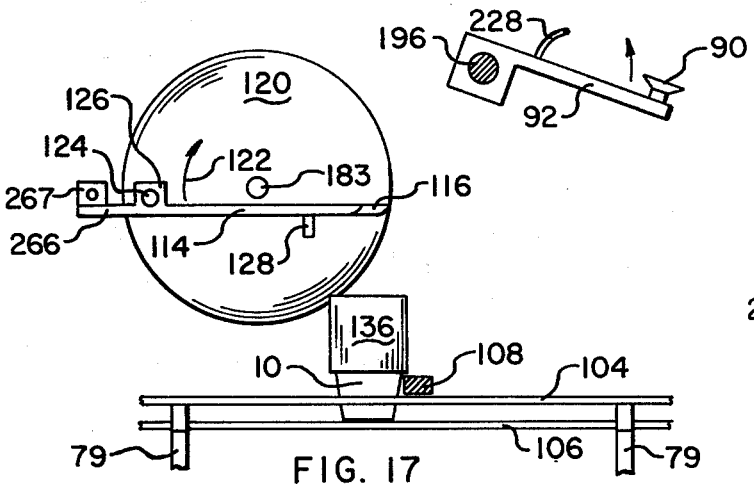
FIG. 17 is a view similar to the view shown in FIG. 15 showing the presser arms removed from the top of the locked carton and showing the arms returning to their initial position to press the top of the next carton being removed and opened from the hopper.

Referring now to FIG. 17 of the drawing, there is shown a similar view to the view shown in FIG. 15 showing the presser arms 114 and 116 removed from the top of the locked carton 136 and showing the arms returning to their initial position by means of the cam 120 to be in a position to press the top of the next carton 136 being removed and opened from the hopper 80. In a similar manner, the suction cup 90 is still progressing towards the hopper 80 and is ready to be positioned beneath the hopper 80 and to have the vacuum reapplied in order to withdraw the next folded carton 12 from the hopper 80.

Figure 19:
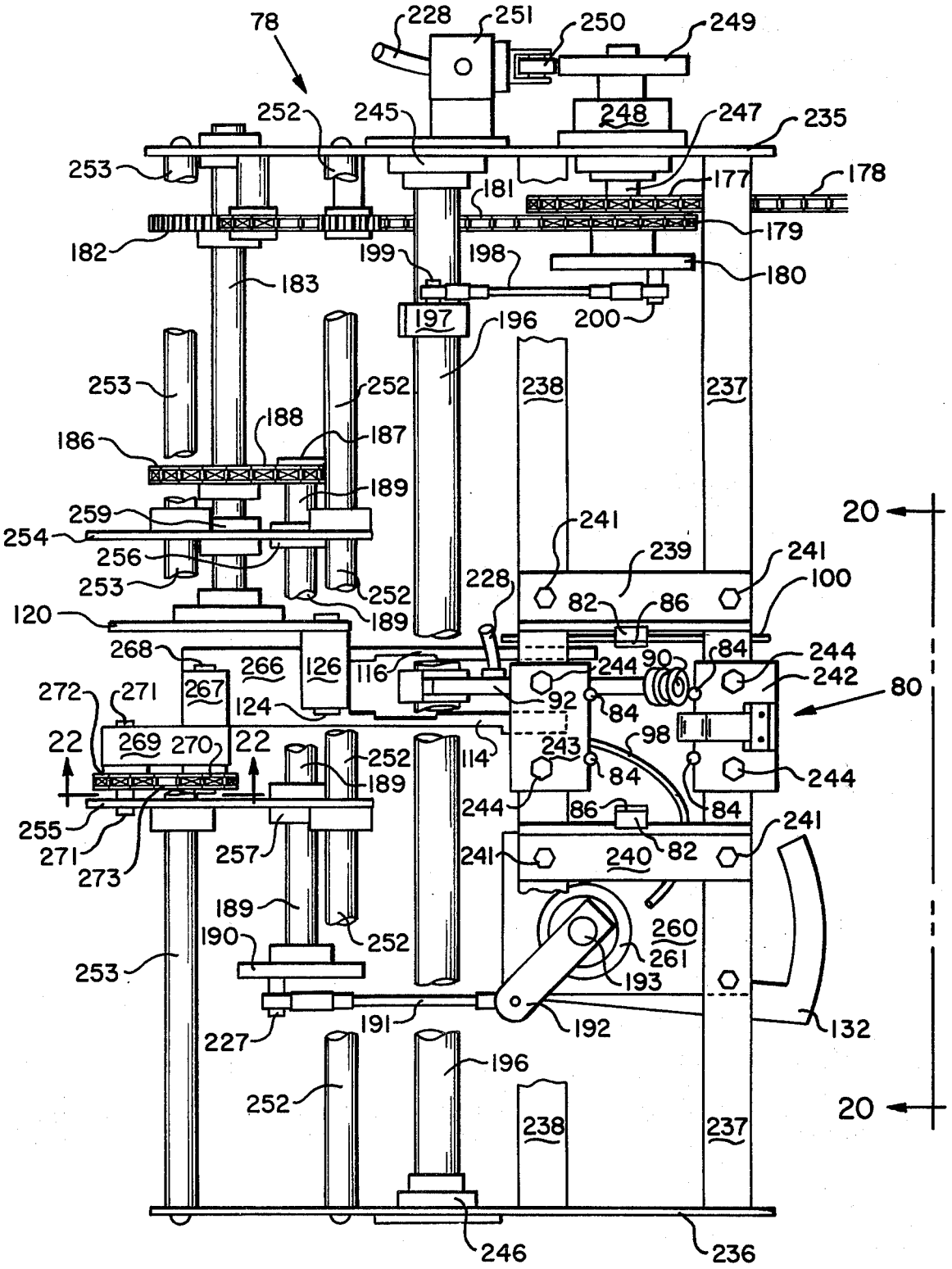
FIG. 19 is a top view of the subject topper unit showing a preferred mounting in an actual machine of the various parts forming the topper unit and the relationship of the parts to each other and to the various drive connections as shown in FIG. 18 of the drawing.

Referring now to FIG. 19 of the drawings, there is shown a top view of the subject first topper unit 78 of the two unit installation shown in FIG. 18 of the drawing showing a preferred mounting in an actual machine of the various parts forming the first topper unit 78 and the relationship of the parts to each other and to the various drive connections as shown in FIG. 18 of the drawing. As has been mentioned before, the frame 79 of the subject invention carries the basic components of the machine and may comprise a pair of side plates 235 and 236 which are rigidly fastened to the legs of the subject machine. The side plates 235 and 236 are utilized to carry the hopper 80 by means of a pair of angles 237 and 238. The angles 237 and 238 span the distance between the side plates 235 and 236 and are rigidly attached thereto by means well known in the art. Positioned between the angles 237 and 238 are a pair of angles 239 and 240 which are bolted to the angles 237 and 238 by a plurality of bolts and nuts 241. The angles 239 and 240 have fixedly attached thereto the side rails 82 by means well known in the art. The angles 237 and 238 have fixedly attached thereto a pair of plates 242 and 243 by means of a plurality of bolts and nuts 244. The plates 242 and 243 have fixedly attached thereto the plurality of guide rails 84 hereinbefore described.

The side plates 235 and 236 are designed to carry the shaft 196 by means of the bearings 245 and 246 and are also designed to carry a shaft 247 by means of the bearing 248. The shaft 247 carries the sprocket 177, the sprocket 179 and the cam 180 as well as a cam 249 which is designed to act in conjunction with a cam follower 250 to control the vacuum line 228 which controls the vacuum to the suction cup 90 by means of a valve 251. The valve 251 is fixedly attached to the side plate 235 by means well known in the art.

Positioned between the side plates 235 and 236 are a pair of rods 252 and 253 which are fixedly attached to the side plates 235 and 236 by means well known in the art. The rods 252 and 253 have attached thereto a pair of vertical plates 254 and 255 which are utilized to carry the shaft 189 by means of the bearings 256 and 257 and are utilized to support the shaft 183 by means of the bearing 259. It should be remembered that the shaft 183 is used to drive the cam 120 which in turn drives the presser arms 114 and 116 as has been before described. In addition, the shaft 183 also drives the shaft 189 which in turn drives the cam 190 whose function is to drive the rotating squaring means 130 in the form of a generally C shaped squaring arm 132. The bearing 261 surrounding the pin 193 is carried by a plate 260 which will be shown in more detail in FIG. 20 of the drawings.

Figure 20:
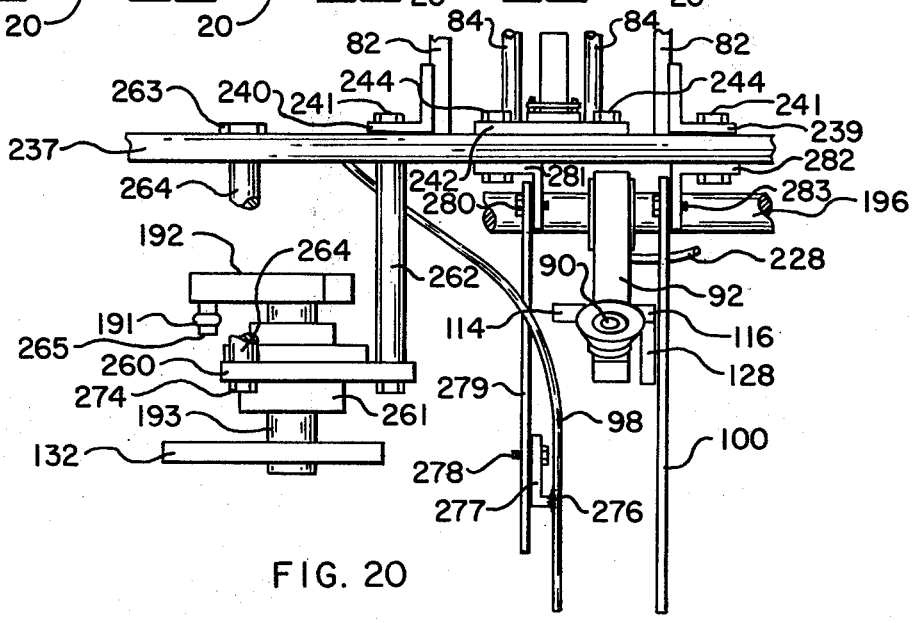
FIG. 20 is an end view taken along line 20—20 of FIG. 19 showing the mounting of the static folding rail and static folding plate.

FIG. 20 of the drawing shows an end view taken along line 20—20 of FIG. 19 and details how the plate 260 is carried by the angles 237, 238 and 240. In addition it details how the static folding rail 98 and the static folding plate 100 are carried by the angle 237 and ultimately by the frame 79.

As has been before described the angles 239 and 240 are bolted to the angles 237 and 238 by a plurality of bolts 241. The bolts holding the angle 240 are elongated and are positioned in a sleeve 262 which is used to space the plate 260 at a desired position as shown in FIG. 20. In addition a bolt 263 is positioned in a sleeve 264 and through the angle 237 to fully support the plate 260 being held by a nut 274. As has been hereinbefore described the plate 260 carries the bearing 261 through which the pin 193 is positioned and which allows the arm 132 to horizontally move by means of the plate 192 fixedly attached to the other end on the pin 193. The plate 192 also has a pin 265 attached thereto which connects to the arm 191.

FIG. 20 also shows in detail how the static folding rail 98 and the static folding plate 100 may be connected to the frame structure of the machine. The static folding rail is welded by means of the weld 276 which is in turn fastened, by means of a screw 278, to a vertical plate 279. The plate 279 is fastened, by means of the screw 280, to an angle 281 which is bolted to the underside of the angle 237 by means of the bolt and nut 244. In a similar manner the static folding plate 100 may be bolted to the underside of the angle 237 by means of the angle 282 and the screw 283. The other side of the static folding plate 100 would be fastened in a like manner to the underside of the angle 238 but not shown in the drawings.

Referring now back to FIG. 19 of the drawing there is shown how the pressing means 112 is maintained in a generally horizontal position throughout the rotation of the cam 120. An elongated rear portion 266 of the pressing means 112 carries a block 267 rigidly attached thereto and having a pin 268 centrally located therein. The pin 268 passes through the block 269 and carries a sprocket 270. The block 269 also carries a pin 271 which carries a sprocket 272 which in turn is chained to the sprocket 270 by means of the chain 273. The pin 271 is also carried by the plate 255.

From this it can be seen that whenever the cam 120 rotates the block 126 fixedly attached to the elongated rear portion 266, the block 267 will retain the elongated rear portion 266 in the horizontal position as the pin 268 and the block 269 rotate around the pin 271 as does the sprocket 270 and the chain 273 rotating on the sprocket 272. As a result, the presser arm 114 and 116 are able to be maintained horizontal throughout the rotation of the cam 120.

Figure 22:
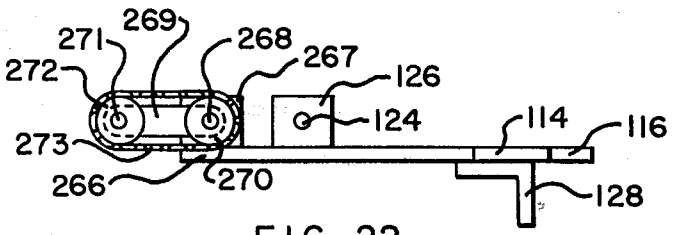
FIG. 22 is a sectional view taken along line 22—22 of FIG. 19.

Referring now to FIG. 22 there is shown a sectional view taken along line 22—22 of FIG. 19 showing the elongated rear portion 266 and the various parts connected thereto which are utilized to keep the elongated rear portion 266 horizontal during the pressing motion of the presser arms 114 and 116.

Figure 21:
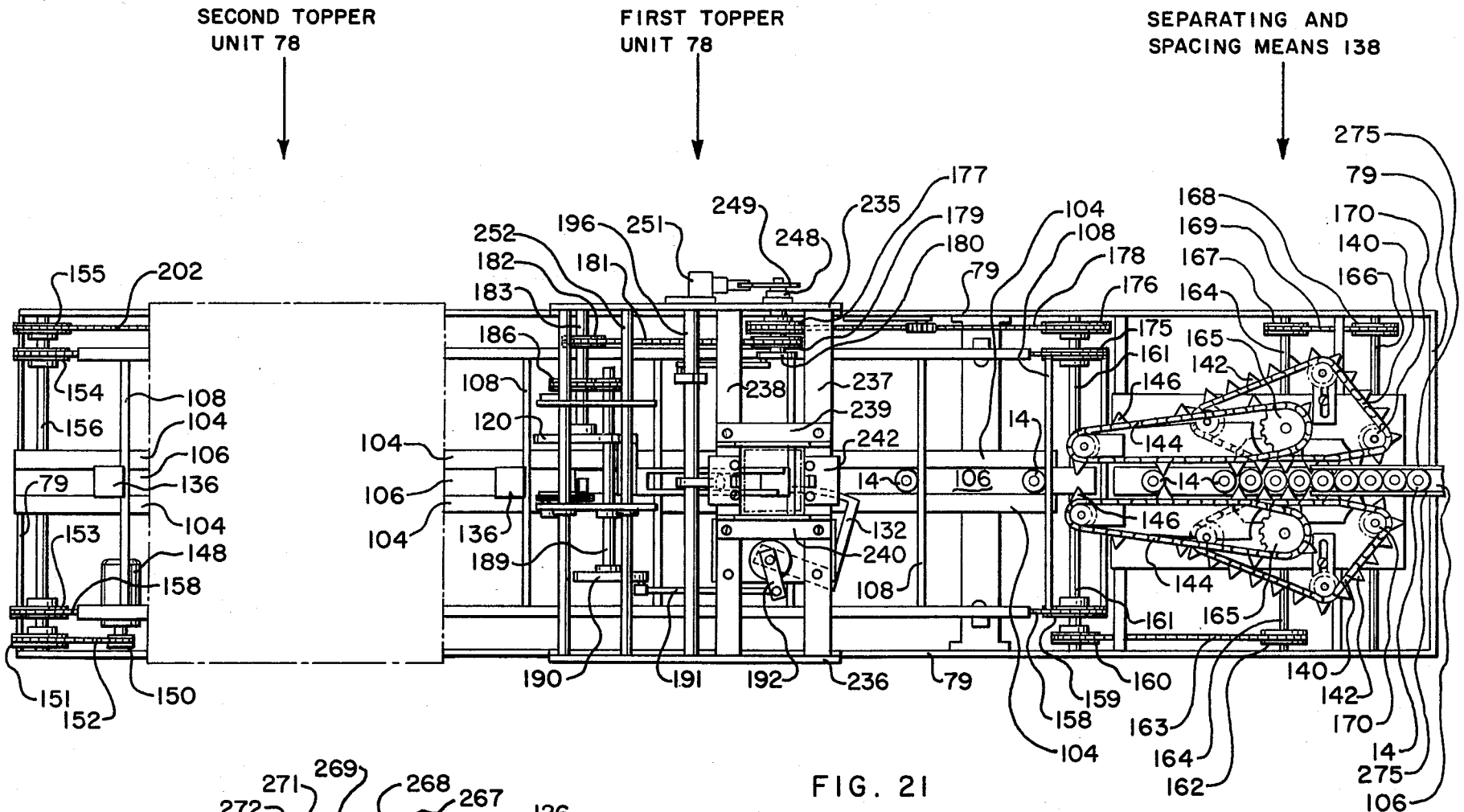
FIG. 21 is a top view of the subject topper machine showing the placement of two topper units in relation to the separating and spacing means with the second topper unit being omitted for brevity.

Referring now to FIG. 21 there is shown a top view of the subject topper machine showing the placement of the two topper units 78 in relation to the separating and spacing means 138. In FIG. 21 the second topper unit 78 has been omitted for brevity and would be similar to the first topper unit. It will be noted that the top view in FIG. 21 also corresponds to the schematic diagram in FIG. 18 and shows in greater detail the connection of the various parts to the basic frame and side plates. It will be noted in FIG. 21 how the dead plate 106 supports a plurality of bottles on the right side of the drawing at the entrance to the separating and spacing means 138. The dead plate 106 would normally extend upstream to the bottler and have a pair of side plates 275 which act to guide the bottles 10 from the bottler into the topper.

As the bottles enter the topper they are separated by means of the selector chains 140 and selector lugs 142 which are inserted between each bottle. Thereafter the bottles 10 are spaced by means of a pair of speed up chains 144 and speed up lugs 146. The speed up lugs 146 are positioned into the same space as formerly occupied by the selector lugs and act to speed up the travel of the bottles 10 until they are spaced apart from each other and are picked up by the traveling flight bars 108 and conveyed downstream beneath the various topper units 78.

METHOD

When the subject topper unit or units are utilized in a topper packaging machine, the method for withdrawing a pre-glued open ended and folded carton from a hopper and opening a carton and applying it to the top of a bottle comprises generally the steps of providing a bottle in a predetermined position beneath the hopper and then withdrawing the pre-glued and folded carton downwardly and away from the hopper while turning at 90° from its previous position in the hopper. The withdrawing and turning step serves also to open the folded carton so that its open end is downwardly facing and is positioned over the bottle. The withdrawing from the hopper is accomplished by a rotating suction cup and the carton is opened by the suction cup pulling the folded carton through a folding means which may comprise at least one static folding rail mounted below the hopper and further comprises a static folding plate mounted opposite to the static folding rail and below the hopper. Thereafter the next step in the method is to press the downwardly facing open carton on top of the bottle while squaring up the carton until the carton is locked on the bottle with the pressing being accomplished by a plurality of rotating presser arms and with the carton being squared up by a rotating squaring arm.

There is also provided in the method a timing of the moving bottles so that a bottle is always positioned beneath an opened carton below a given topper unit.

From the foregoing and in summary it can be seen that there has been provided by the subject invention a new and novel topper unit, a machine and method for utilizing the topper unit and a machine to open, apply and lock a pre-glued open ended carton on top of the bottle which is being progressively moved through the machine employing the topper unit. The new and novel topper unit and topper packaging machine has been provided which accomplishes all of the objects and advantages of the invention. Nevertheless, it is apparent that many changes in details of construction or arrangement of the parts of the invention or in the steps of the method may be made without departing from the spirit and scope of the invention as expressed in the accompanying claims and the invention is not to be limited to the exact matter shown and described since only the preferred embodiments have been given by way of illustration only.

Having described my invention, I claim:

1. A topper unit for opening, applying and locking a pre-glued open ended carton to the top of a bottle, comprising:

a. a frame;

b. a hopper mounted on said frame and serving as a receptacle for a plurality of pre-glued and folded cartons;

c. means, associated with and located below said hopper, for removing the cartons one at a time from the hopper;

d. means, mounted on said frame and located beneath said hopper, for opening said cartons while said removing means is removing the cartons from the hopper;

e. means, associated with said frame, for moving and positioning a bottle beneath the opened carton;

f. means, associated with said frame, for pressing the previously opened carton on top of the bottle and locking it onto the bottle; and g. means, associated with said frame, for squaring up the carton as it is being pressed on top of the bottle.

2. The topper unit as defined in claim 1 wherein said removing means comprises a rotatably mounted suction cup positioned beneath said hopper and designed to withdraw the carton from the bottom of the hopper.

3. The topper unit as defined in claim 1 wherein said opening means comprises a static folding rail positioned beneath said hopper and located on one side thereof and further comprises a static folding plate located beneath said hopper and located on the other side thereof opposite to said static folding rail.

4. The topper unit as defined in claim 1 wherein said moving and positioning means comprises a pair of guide rails mounted on said frame and over a centrally located frame mounted dead plate and further comprises a horizontally traveling flight bar positioned over said guide rails and said dead plate for engaging and moving the bottle.

5. The topper unit as defined in claim 3 wherein said pressing means comprises a pair of vertically moving presser arms located beneath said hopper, one of said arms having formed thereon a downwardly extending stop in juxtaposition to said static folding plate.

6. The topper unit as defined in claim 5 wherein said squaring means comprises a horizontally rotating squaring arm for driving the opened carton against the stop formed on one of the presser arms and against the static folding plate.

7. A topper unit for opening, applying and locking a pre-glued carton to the top of a bottle comprising:

a. a frame;

b. a hopper mounted on said frame for receiving a plurality of pre-glued and folded cartons;

c. a rotatably mounted suction cup associated with said frame and positioned beneath said hopper and mounted and timed so as to be able to withdraw a folded carton one at a time downwardly from the hopper and turn it approximately 90° from its previous position;

d. at least one static folding rail mounted on said frame and positioned beneath said hopper on one side thereof, a static folding plate mounted on said frame and positioned beneath said hopper on the other side thereof opposite to the static folding rail, said static folding rail and static folding plate being positioned in such a manner that a downward moving folded carton is forced between said rail and plate and is opened while it is being turned approximately 90° from its previous position by said rotatably mounted suction cup;

e. means, associated with said frame, for moving and positioning a bottle beneath the opened carton;

f. a pair of parallel mounted vertically moving presser arms mounted beneath said hopper and associated with said frame for pressing the opened carton onto the horizontally moving bottle to lock the carton in position on the bottle, one of said presser arms having formed thereon a downwardly extending stop in juxtaposition to said static folding plate; and g. a horizontally rotating squaring arm associated with said frame for driving one corner of the opened carton against the stop formed on the presser arm and against the static folding plate, said arm serving to square up the carton and hold it square until the presser arms are able to press the opened carton onto the moving bottle.

8. A machine for opening, applying and locking a plurality of pre-glued cartons to the tops of a plurality of moving separated bottles, comprising:

a. a frame;

b. means, associated with said frame, for separating and spacing the bottles in a single file at a predetermined distance from each other;

c. means, associated with said frame and located downstream from said separating means, for moving and positioning the separated bottles at a predetermined speed and at a predetermined location through the machine;

d. at least one topper unit, associated with said frame and located above the separated bottles for withdrawing a plurality of folded pre-glued cartons one at a time from a hopper, opening the cartons, positioning the cartons and locking the cartons one at a time onto the moving bottles, said topper unit comprising;

1. a frame;

2. a hopper mounted on said frame and serving as a receptacle for a plurality of pre-glued and folded cartons;

3. means, associated with and located below said hopper, for removing the cartons one at a time from the hopper;

4. means, mounted on said frame and located beneath said hopper, for opening said cartons while said removing means is removing the cartons from the hopper;

5. means, associated with said frame, for moving and positioning a bottle beneath the opened carton;

6. means, associated with said frame, for pressing the previously opened carton on top of the bottle and locking it onto the the bottle; and 7. means, associated with said frame, for squaring up the carton as it is being pressed on top of the bottle.

9. The machine as defined in claim 8 further comprising said machine having associated therewith at least two topper units located one downstream from the other.

10. The machine as defined in claim 8 further comprising said machine having associated therewith at least three topper units located in a row.

11. A method for withdrawing a pre-glued open ended and folded carton from a hopper, opening the carton and applying it to the top of a bottle, comprising the steps of:

a. providing a bottle in a predetermined position beneath the hopper;

b. withdrawing the pre-glued and folded carton downwardly and away from the hopper while turning it 90° from its previous position in the hopper, the withdrawing and turning serving also to open the folded carton so that its open end is downwardly facing and is positioned over the bottle; and c. pressing the downwardly facing opened carton on top of the bottle while squaring up the carton until the carton is locked on the bottle.

12. The method as defined in claim 11 wherein the carton is withdrawn from the hopper by a rotating suction cup and is opened by the suction cup pulling the folded carton through a folding means.

13. The method as defined in claim 12 wherein said folding means comprises a static folding rail mounted below the hopper and further comprises a static folding plate mounted opposite to said static folding rail and below the hopper.

14. The method as defined in claim 11 wherein the carton is pressed on top of the bottle by a plurality of rotating presser arms and is squared up by a rotating squaring arm.

15. A method for applying and locking a plurality of pre-glued open ended cartons to the tops of a plurality of moving bottles comprising the steps of:

a. providing a plurality of separated bottles in a moving row;

b. providing at least one hopper filled with a quantity of pre-glued and folded cartons positioned above the moving row of bottles;

c. withdrawing the folded carton downwardly and away from the hopper while turning the carton 90° from its previous position in the hopper, the withdrawing and turning serving also to open the folded carton so that its open end is downwardly facing and positioned over a bottle;

d. timing the moving bottles so that a bottle is always positioned beneath an opened carton; and e. pressing and locking the downwardly facing open ended carton on top of the bottle while squaring up the carton and while moving the bottle and carton away from the proximity of the hopper.

16. The method as defined in claim 15 wherein the carton is withdrawn from the hopper by a rotating suction cup and is opened by the suction cup pulling the folded carton through a folding means.

17. The method as defined in claim 16 wherein said folding means comprises a static folding rail mounted below the hopper and further comprises a static folding plate mounted opposite to said static folding rail and below the hopper.

18. The method as defined in claim 15 wherein the carton is pressed on top of the bottle by a plurality of rotating presser arms and is squared up by a rotating squaring arm.

19. A topper unit for opening, applying and locking a pre-glued carton to the top of a bottle comprising:

a. a frame;

b. an open ended vertically mounted hopper mounted on said frame for receiving a predetermined quantity of horizontally stacked pre-glued and folded cartons;

c. a rotatably mounted suction cup associated with said frame and positioned beneath said hopper and mounted and timed so as to be able to withdraw a folded carton one at a time downwardly from the hopper, said suction cup withdrawing the carton by pulling it downwardly by one side of the carton and then rotating it approximately 90° from its previous horizontal position;

d. an elongated bent static rail mounted on said frame and positioned beneath said hopper, said static rail initiating at the hopper on one side of the hopper and terminating below the hopper at approximately midpoint in the hopper, a vertical static folding plate mounted on said frame and positioned beneath said hopper on the other side of the hopper from the static folding rail, said static folding rail and static folding plate being positioned in such a manner that a downward moving folded carton is forced between said rail and plate and is opened while it is turned approximately 90° from its previous position by said rotatably mounted suction cup;

e. means, associated with said frame, for moving and positioning a bottle beneath the opened carton, said means comprising a horizontally traveling flight bar located beneath said hopper and positioned above a pair of frame mounted guide rails and a centrally located frame mounted dead plate, said rails and dead plate serving to guide the bottle as the traveling flight bar moves the bottle horizontally in a timed sequence to position the bottle beneath the opened carton;

f. a pair of parallel mounted, cam operated, vertically moving presser arms mounted beneath said hopper and associated with said frame for pressing the opened carton onto the horizontally moving bottle to lock the carton in position on the bottle, one of said presser arms having formed thereon a downwardly extending stop in juxtaposition to said static folding plate; and g. a horizontally rotating C-shaped squaring arm associated with said frame for driving one corner of the opened carton against the stop formed on the presser arm and against the static folding plate to thereby square up the carton and hold it square until the presser arms have completed pressing the opened carton onto the moving bottle.

* * * * *

UNITED STATES PATENT OFFICE

CERTIFICATE OF CORRECTION

PATENT NO. : 3,965,643

DATED : June 29, 1976

INVENTOR(S) : Earle Conrad Sherman

It is certified that error appears in the above-identified patent and that said Letters Patent are hereby corrected as shown below:

Column 4, line 7, after the word "drawing" delete -- .-- and insert in place thereof -- ; --.

Column 6, line 3, omit -- 79 -- and insert in place thereof -- 78 --.

Column 7, Line 31, omit -- 147 -- and insert in place thereof -- 148 --.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*